US008978190B2

(12) United States Patent
Leifheit et al.

(10) Patent No.: US 8,978,190 B2
(45) Date of Patent: Mar. 17, 2015

(54) REMOVABLE PAD FOR INTERCONNECTION TO A HIGH-SPEED DRIVER SYSTEM

(75) Inventors: Todd Leifheit, Littleton, CO (US); Steven Tucker, Centennial, CO (US)

(73) Assignee: Karcher North America, Inc., Englewood, CO (US)

( * ) Notice: Subject to any disclaimer, the term of this patent is extended or adjusted under 35 U.S.C. 154(b) by 441 days.

(21) Appl. No.: 13/171,237

(22) Filed: Jun. 28, 2011

(65) Prior Publication Data

US 2013/0005224 A1 Jan. 3, 2013

(51) Int. Cl.

| | |
|---|---|
| ***A47L 11/12*** | (2006.01) |
| ***A47L 11/162*** | (2006.01) |
| ***A47L 11/202*** | (2006.01) |
| ***A47L 11/40*** | (2006.01) |
| ***B24B 7/18*** | (2006.01) |

(52) U.S. Cl.

CPC ..... *A47L 11/162* (2013.01); *A47L 11/2025* (2013.01); *A47L 11/4038* (2013.01); *B24B 7/186* (2013.01)

USPC ..... 15/98; 15/49.1; 15/50.1; 15/230; 15/230.19

(58) Field of Classification Search

USPC ..... 15/340.1, 340.2, 340.3, 340.4, 49.1, 15/50.1, 98, 230, 230.19; 451/353, 359

See application file for complete search history.

(56) References Cited

U.S. PATENT DOCUMENTS

| | | | | |
|---|---|---|---|---|
| 1,596,041 | A | 8/1926 | Young | |
| 1,639,959 | A | 8/1927 | Owen | |
| 1,888,339 | A | 11/1932 | White | |
| 1,900,889 | A | 3/1933 | Becker | |
| 1,922,912 | A * | 8/1933 | Fox | 15/230.19 |
| 1,995,084 | A | 3/1935 | Wichle | |
| 1,999,696 | A | 4/1935 | Kitto | |
| 2,192,397 | A | 3/1940 | Carlson | |
| 2,263,762 | A | 11/1941 | Dow et al. | |
| 2,668,979 | A | 2/1954 | MacFarland | |
| 2,930,056 | A * | 3/1960 | Lappin | 15/49.1 |
| 3,005,224 | A | 10/1961 | Magarian | |
| 3,065,490 | A | 11/1962 | Arones | |
| 3,093,853 | A | 6/1963 | Tamny | |
| 3,145,585 | A * | 8/1964 | Brown | 475/178 |

(Continued)

FOREIGN PATENT DOCUMENTS

| | | |
|---|---|---|
| BR | PI 0511488 | 1/2008 |
| CA | 2242793 | 7/1998 |

(Continued)

OTHER PUBLICATIONS

"Scmidt Produkte: Kleinkehrfahrzeug Galopio", Photo of Galopio device, available at http://database.schmidtgroup.net/loader.php//en/schmidt/swk/products/00011/picture1.html, as early as Apr. 29, 2003, printed on Jan. 29, 2007, p. 1.

"Scmidt Produkte: Kleinkehrfahrzeug Galopio", Photo of Galopio device, available at http://database.schmidtgroup.net/loader.php/de/schmidt/swk/00011/, as early as May 29, 2003, printed on Jan. 29, 2007, p. 1.

Fantomat Sale Sheet, BUZILI-WERK Wagner GmbH & Co.

Galopio Cleaning Device, www.schmidt-holding.com, accessed Feb. 23, 2005, 4 pages.

(Continued)

*Primary Examiner* — Monica Carter
*Assistant Examiner* — Michael Jennings
(74) *Attorney, Agent, or Firm* — Sheridan Ross P.C.

(57) ABSTRACT

A floor care machine is provided that includes a replaceable floor care element that is quickly and easily attached and detached. To attach the floor care element, an operator positions the floor care element under a motor and lifts the element up to a motor interface. The motor interface aligns with a complementary interface of the floor care element.

12 Claims, 8 Drawing Sheets

(56) References Cited

U.S. PATENT DOCUMENTS 3,193,862 A 7/1965 Lyon
3,206,787 A 9/1965 Daniels et al.
3,233,274 A 2/1966 Kroll
3,284,830 A 11/1966 Kroll
3,376,675 A * 4/1968 Hutchins ..... 451/508
3,401,416 A 9/1968 Ziegler
3,436,788 A 4/1969 Tamny
3,461,479 A 8/1969 Tierney
3,504,858 A 4/1970 Liddiard
3,506,080 A 4/1970 Hott
RE26,950 E 9/1970 Hays
3,600,735 A 8/1971 Jerabek
3,604,051 A 9/1971 Wendall et al.
3,631,558 A 1/1972 Kovacevoc
3,705,437 A 12/1972 Rukauina, Jr. et al.
3,705,746 A 12/1972 McLeod
3,833,961 A 9/1974 Fortman et al.
3,846,865 A 11/1974 Holman
3,879,789 A 4/1975 Kasper
3,883,301 A 5/1975 Emrick et al.
3,892,003 A 7/1975 Peabody
3,981,106 A 9/1976 Gallo
4,010,507 A 3/1977 Johnson
4,019,218 A 4/1977 Cyphert
4,037,289 A 7/1977 Dojan
4,046,321 A 9/1977 Hewett
4,122,576 A * 10/1978 Bevington et al. ..... 15/49.1
4,135,669 A 1/1979 Bridges et al.
4,196,492 A 4/1980 Johnson et al.
4,200,952 A 5/1980 Smies et al.
4,214,338 A 7/1980 Kyle et al.
4,293,971 A 10/1981 Block
4,339,841 A 7/1982 Walhauser et al.
4,354,569 A 10/1982 Eichholz
D267,084 S 11/1982 Bittinger
4,383,551 A 5/1983 Lynch et al.
4,391,548 A 7/1983 Malish
D273,621 S 4/1984 Haub et al.
4,499,624 A 2/1985 Bloom et al.
4,538,695 A 9/1985 Bradt
4,596,061 A 6/1986 Henning
4,654,918 A * 4/1987 Cooper ..... 15/98
D290,053 S 5/1987 Block
D290,054 S 5/1987 Block
4,662,024 A 5/1987 Moench
4,675,935 A 6/1987 Kasper et al.
4,715,087 A 12/1987 Todd et al.
4,716,980 A 1/1988 Butler
4,731,895 A 3/1988 Zack et al.
4,742,652 A 5/1988 Cannan et al.
4,754,521 A * 7/1988 Zoni ..... 15/340.1
4,759,094 A 7/1988 Palmer et al.
4,805,258 A 2/1989 Sitarski et al.
4,809,397 A 3/1989 Jacobs et al.
4,847,944 A 7/1989 Lackner
4,850,077 A 7/1989 Venturini
4,866,804 A 9/1989 Masbruch et al.
4,874,055 A 10/1989 Beer
4,879,784 A 11/1989 Shero
4,920,997 A 5/1990 Vetter et al.
4,924,636 A * 5/1990 Hoffman ..... 451/357
5,044,043 A 9/1991 Field et al.
5,054,150 A 10/1991 Best et al.
5,075,921 A 12/1991 Gleadall
D323,797 S 2/1992 Oslapas et al.
5,123,139 A 6/1992 Leppert et al.
5,127,124 A 7/1992 Palmer et al.
5,135,080 A 8/1992 Haston
5,138,735 A 8/1992 Kusz et al.
5,168,947 A 12/1992 Rodenborn
5,174,730 A 12/1992 K et al.
5,217,166 A 6/1993 Schulze et al.
5,221,026 A 6/1993 Williams
5,243,727 A * 9/1993 Tanaka et al. ..... 15/98
5,245,144 A 9/1993 Stammen
5,259,085 A 11/1993 Marafante et al.
5,347,673 A 9/1994 Nickels, Jr.
5,355,542 A * 10/1994 Oreck et al. ..... 15/49.1
5,369,838 A * 12/1994 Wood et al. ..... 15/320
5,400,461 A 3/1995 Malish et al.
5,416,949 A 5/1995 Jute
5,421,053 A 6/1995 Chodak
5,435,038 A 7/1995 Sauers
5,465,451 A 11/1995 Stegens
5,502,868 A 4/1996 Braeendle
5,509,162 A 4/1996 Burgoon
D370,320 S 5/1996 Hachtmann
5,537,712 A 7/1996 Weber et al.
5,555,595 A 9/1996 Ligman
5,607,178 A 3/1997 Legatt et al.
5,608,939 A 3/1997 Waldhauser et al.
5,645,365 A 7/1997 Malish et al.
5,742,975 A 4/1998 Knowlton et al.
5,785,453 A 7/1998 Marty et al.
5,802,665 A * 9/1998 Knowlton et al. ..... 15/340.4
5,806,132 A 9/1998 Kelley
5,881,417 A * 3/1999 Knowlton ..... 15/52.1
5,884,353 A * 3/1999 Berg et al. ..... 15/83
5,890,558 A * 4/1999 Keegan ..... 180/211
5,898,970 A 5/1999 Straiton
5,901,409 A 5/1999 Schick et al.
5,984,031 A 11/1999 Velke et al.
6,023,813 A 2/2000 Thatcher et al.
6,030,465 A 2/2000 Marcussen et al.
6,059,055 A 5/2000 Velke et al.
6,070,290 A * 6/2000 Schwarze et al. ..... 15/340.1
6,088,873 A 7/2000 Pacchini et al.
6,105,203 A * 8/2000 Hueppi et al. ..... 15/320
6,138,317 A * 10/2000 Holmes et al. ..... 15/180
6,145,855 A 11/2000 Bellis, Jr. et al.
6,158,084 A 12/2000 Weber et al.
6,158,673 A 12/2000 Toetschinger
6,163,915 A * 12/2000 Kaczmarz et al. ..... 15/49.1
6,206,980 B1 3/2001 Robinson
6,230,363 B1 5/2001 Kawai et al.
6,266,892 B1 7/2001 Haynie
6,283,170 B1 9/2001 Robinson
6,302,230 B1 10/2001 Kamen et al.
6,367,120 B2 4/2002 Beauchamp
6,371,228 B1 4/2002 Husted et al.
6,397,429 B1 6/2002 Legatt et al.
6,425,958 B1 7/2002 Giddings et al.
6,431,217 B2 8/2002 Robinson
6,442,789 B1 9/2002 Legatt et al.
6,450,867 B1 9/2002 Legatt
6,453,506 B1 9/2002 Sumner
6,464,025 B1 10/2002 Koeper et al.
6,490,849 B1 12/2002 Scag et al.
6,497,422 B1 12/2002 Bellis, Jr. et al.
6,523,214 B1 * 2/2003 Kaiser ..... 15/230
6,533,871 B2 3/2003 Zahuranec et al.
6,535,793 B2 3/2003 Allard
6,553,609 B2 4/2003 Tremmel et al.
6,554,207 B2 4/2003 Ebberts
6,585,827 B2 7/2003 Field et al.
6,594,844 B2 7/2003 Jones
6,625,843 B2 9/2003 Kim et al.
6,629,333 B2 10/2003 Bolden et al.
6,647,585 B1 11/2003 Robinson
6,650,975 B2 11/2003 Ruffner
6,651,286 B2 * 11/2003 Pierce ..... 15/98
6,671,925 B2 1/2004 Field et al.
6,684,452 B2 2/2004 Lehman et al.
6,705,332 B2 3/2004 Field et al.
6,721,990 B2 4/2004 Zahuranec et al.
6,725,512 B2 4/2004 Carter et al.
6,735,811 B2 5/2004 Field et al.
6,735,812 B2 5/2004 Hekman et al.
6,760,947 B2 7/2004 Stuchlik
6,772,475 B2 8/2004 Weber et al.
6,789,290 B2 9/2004 Kent et al.
6,842,940 B2 1/2005 Christopher et al.
6,845,829 B2 1/2005 Hafendorfer
6,849,829 B1 2/2005 Hafendorfer

(56) References Cited

U.S. PATENT DOCUMENTS

| | | | | |
|---|---|---|---|---|
| 6,871,371 | B2 * | 3/2005 | Guest | 15/49.1 |
| 6,918,156 | B2 | 7/2005 | Joo et al. | |
| 6,918,603 | B2 | 7/2005 | Boyd | |
| 6,941,614 | B2 | 9/2005 | Montgomery | |
| 6,981,338 | B2 | 1/2006 | Jensen et al. | |
| 7,025,835 | B2 | 4/2006 | Pedlar et al. | |
| 7,047,585 | B2 * | 5/2006 | Boyer et al. | 15/97.1 |
| 7,048,805 | B2 | 5/2006 | Kent et al. | |
| 7,059,004 | B2 * | 6/2006 | Mitchell et al. | 15/50.1 |
| 7,108,593 | B2 | 9/2006 | Janson | |
| 7,326,106 | B1 * | 2/2008 | Rogers et al. | 451/350 |
| 7,337,490 | B2 * | 3/2008 | Goff | 15/320 |
| 7,370,386 | B2 | 5/2008 | Lehman et al. | |
| 7,533,435 | B2 * | 5/2009 | Pedlar et al. | 15/49.1 |
| 7,587,779 | B2 * | 9/2009 | Walz et al. | 15/49.1 |
| 7,657,960 | B2 | 2/2010 | Umbrell | |
| 7,713,110 | B2 | 5/2010 | Lampka et al. | |
| 7,815,393 | B2 * | 10/2010 | Snyder et al. | 404/112 |
| 8,079,107 | B2 * | 12/2011 | Katenhusen et al. | 15/50.3 |
| 8,332,983 | B1 * | 12/2012 | Prohoroff | 15/87 |
| 8,341,793 | B2 * | 1/2013 | Walker et al. | 15/98 |
| 8,393,937 | B2 * | 3/2013 | Goldberg et al. | 451/353 |
| 2002/0073494 | A1 * | 6/2002 | Stuchlik | 15/49.1 |
| 2002/0073505 | A1 | 6/2002 | Bolden | |
| 2002/0178522 | A1 | 12/2002 | Buchegger | |
| 2003/0115697 | A1 | 6/2003 | Deiterman | |
| 2003/0126729 | A1 * | 7/2003 | Pierce | 29/90.01 |
| 2003/0159225 | A1 | 8/2003 | Kuo | |
| 2003/0192963 | A1 | 10/2003 | Ebberts | |
| 2004/0040102 | A1 | 3/2004 | Field et al. | |
| 2004/0045108 | A1 | 3/2004 | Fellhauer | |
| 2004/0172769 | A1 | 9/2004 | Giddings et al. | |
| 2004/0187895 | A1 | 9/2004 | Field et al. | |
| 2004/0221407 | A1 | 11/2004 | Field et al. | |
| 2004/0226578 | A1 | 11/2004 | Guest et al. | |
| 2004/0226584 | A1 | 11/2004 | Guest et al. | |
| 2004/0262871 | A1 | 12/2004 | Schreuder et al. | |
| 2005/0028316 | A1 * | 2/2005 | Thomas et al. | 15/320 |
| 2006/0064844 | A1 | 3/2006 | Venard et al. | |
| 2006/0124770 | A1 | 6/2006 | Vernard et al. | |
| 2006/0143843 | A1 * | 7/2006 | Benedict | 15/50.1 |
| 2006/0143844 | A1 * | 7/2006 | Klucznik | 15/50.1 |
| 2006/0156498 | A1 * | 7/2006 | Venard et al. | 15/52.1 |
| 2007/0266514 | A1 | 11/2007 | Umbrell | |
| 2008/0072386 | A1 | 3/2008 | Kelley | |
| 2008/0216259 | A1 * | 9/2008 | Walz et al. | 15/49.1 |
| 2009/0094784 | A1 * | 4/2009 | Pedlar et al. | 15/340.1 |
| 2010/0071143 | A1 * | 3/2010 | Walker et al. | 15/98 |
| 2010/0125966 | A1 | 5/2010 | Stein | |
| 2010/0197210 | A1 * | 8/2010 | Goldberg et al. | 451/353 |
| 2010/0212690 | A1 * | 8/2010 | Linden et al. | 134/6 |

FOREIGN PATENT DOCUMENTS

| | | |
|---|---|---|
| CA | 2268234 | 10/1999 |
| DE | 1270066 | 6/1968 |
| DE | 1658384 | 4/1971 |
| DE | 69011648 | 12/1994 |
| DE | 4440202 | 5/1995 |
| DE | 9421472 | 1/1996 |
| DE | 4429996 | 2/1996 |
| DE | 9421625 | 3/1996 |
| DE | 19539350 | 4/1997 |
| DE | 19745887 | 4/2000 |
| DE | 19851666 | 9/2000 |
| DE | 69608989 | 11/2000 |
| DE | 19927593 | 4/2001 |
| DE | 10029691 | 4/2002 |
| DE | 10030725 | 4/2002 |
| DE | 10062329 | 7/2002 |
| DE | 19851681 | 7/2002 |
| DE | 20204485 | 10/2002 |
| DE | 10142192 | 3/2003 |
| DE | 10204118 | 10/2003 |
| DE | 10218244 | 11/2003 |
| DE | 10221349 | 11/2003 |
| DE | 10221351 | 11/2003 |
| DE | 10221352 | 11/2003 |
| DE | 10307150 | 9/2004 |
| DE | 10324825 | 12/2004 |
| DE | 10324826 | 12/2004 |
| EP | 0017913 | 4/1983 |
| EP | 0281976 | 9/1988 |
| EP | 0283022 | 9/1988 |
| EP | 0176696 | 4/1989 |
| EP | 0176697 | 5/1990 |
| EP | 0421194 | 6/1995 |
| EP | 0792615 | 9/1997 |
| EP | 0867331 | 9/1998 |
| EP | 1023867 | 6/1999 |
| EP | 0951857 | 10/1999 |
| EP | 1108092 | 6/2001 |
| EP | 1164074 | 12/2001 |
| EP | 1260129 | 11/2002 |
| EP | 1265713 | 12/2002 |
| EP | 1108091 | 10/2004 |
| EP | 1335869 | 10/2004 |
| EP | 1604605 | 12/2005 |
| GB | 2338686 | 12/1999 |
| JP | 09-094201 | 4/1997 |
| JP | 2000-217759 | 8/2000 |
| WO | WO 86/01240 | 2/1986 |
| WO | WO 86/02394 | 4/1986 |
| WO | WO 90/10416 | 9/1990 |
| WO | WO 92/13480 | 8/1992 |
| WO | WO 97/15730 | 5/1997 |
| WO | WO 00/74549 | 12/2000 |
| WO | WO 00/79058 | 12/2000 |
| WO | WO 01/05216 | 8/2001 |
| WO | WO 2005/079468 | 9/2005 |
| WO | WO 2009027643 A1 * | 3/2009 |

OTHER PUBLICATIONS

Galopio Operating Instructions, Schmidt Winterdienst-Und Kommunaltechnik, Jan. 17, 2005, Issue 5, pp. 1-84.
Hefter Cleantech, Convert 82, May 19, 2006, 3 pages.
Kärcher, MC600 Multicleaner Brochure, date unknown, 2 pages.
Kärcher, MC600 Multicleaner Brochure, date unknown, 4 pages.
Kärcher, Multicleaner MC 600, Mar. 1990, 7 pages.
Kärcher, Multicleaner MC600 Manual, date unknown, 44 pages.
Kärcher, NT301 Brochure, date unknown, 2 pages.
Kärcher, Worldwide Cleaning Expertise Programme 91/92, published more than one year prior to the filing date of U.S. Patent 6,425,958, which was filed Feb. 2001, 50 pages.
Nobles Typhoon 161OP/1612 Wet/Dry Vacuum Operator and Parts Manual, Jan. 2000, 22 pages Kaivac, Inc.
No-Touch Cleaning Brochure, Kaivac, Inc., dated 2003, 8 pages.
Photo and information related to Galopio device sold on Mascus website, available at http://www.mascus.com/product_card.asp?br=Broddway&catn=Groundscare&page=1&location=EN< . . . , indicates that device was registered in 2000, printed on Jan. 29, 2007, p. 1.
Photo of Galopio device, available at http://www.bassewitz.de/fahrzeuge/schmidt.htm, as early as Jan. 26, 2002, printed on Jan. 29, 2007, pp. 1-2.
Print out of Kaivac No-Touch Clean System, www.Kaivac.com, dated Jan. 23, 2003, 3 pages.
Print out of Nilfisk Aquatron 8 machine, www.mn.nilfisk-advance.com, dated Jan. 30, 2003, 1 page.
Service Master, Boss 2000B Manual, Oct. 1995, 42 pages.
Service Master, Boss 2000E Manual, Aug. 1997, 32 pages.
Service Master, Boss 2000LE Manual, Mar. 1998, 30 pages.
Warning: Your Competitor has a KaiVac, Sep. 1998, 10 pages.

* cited by examiner 134
124
122
126
26
54
50

REMOVABLE PAD FOR INTERCONNECTION TO A HIGH-SPEED DRIVER SYSTEM

This application is related to U.S. patent application Ser. No. 11/059,663, now U.S. Pat. No. 7,533,435; U.S. Patent Application Publication No. 2006/0064844, filed Oct. 17, 2005; and U.S. Patent Application Publication No. 2009/0094784, filed Oct. 5, 2007, the entire disclosures of which are incorporated by reference herein.

FIELD OF THE INVENTION

Embodiments of the present invention relate to a floor care machine that employs an easily attachable and detachable floor care element (e.g., a pad, a brush, etc.).

BACKGROUND OF THE INVENTION

Machines that perform floor care operations such as burnishing, cleaning, polishing, sweeping, scrubbing, etc. include a replaceable floor care element that contacts the floor. In some instances a disk shaped element is provided that contacts the floor and rotates about an axis perpendicular to the floor. Attaching such a floor care element to the bottom of an often heavy floor care machine is time consuming and difficult. Thus, it is desirable to provide floor care elements that are easily attached and detached from the floor care machine.

Burnishing is a process wherein a floor surface is polished after a layer of wax or other finishing material has been added to the floor. Burnishing is performed with a burnishing pad that rotates at a high rate of speed, such as 1,500 RPMs or more. Debris generated by the burnishing process is captured by a shroud that surrounds the burnishing pad. The debris is suctioned from the shroud into a collection receptacle. As burnishing pads wear, regular inspection and replacement is a necessity, so it is desirable to make pad replacement easy and safe.

Burnishing machines are manufactured in two primary forms—self propelled walk-behind and motor-driven. Small walk behind machines include a burnishing pad located under a motor and are very common but are often difficult to control. Such machines also generate uncomfortable vibrations that adversely affect the user. The advantage of self propelled walk-behind machines is that the burnishing pad is easy to access and replace.

Conversely, larger, motor-driven machines provide enhanced control and reduce uncomfortable vibrations. These types of machines may be walk-behind or ride-on. As alluded to above, one disadvantage of larger machines is that the burnishing assembly, which is usually positioned beneath the machine, is difficult to access for inspection and replacement. More specifically, cleaning or burnishing pads are often centered under the machine to protect the pad and associated driving mechanisms from damage. In addition, placing the pad under the machine minimizes the length of the machine, which is desirable. However, in these configurations removal and replacement of the pad must be performed as a "blind" operation.

Thus, there is a long felt need to provide a floor care machine that includes a pad driver mechanism that facilitates attachment and detachment of a floor care element. The following disclosure describes an improved pad interconnection system that selectively receives a burnishing pad assembly and facilitates attachment and detachment of the same.

SUMMARY OF THE INVENTION

It is one aspect of the present invention to provide a floor care machine. More specifically, one embodiment of the present invention includes a chassis that supports a housing. The housing conceals most of the internal components of the floor care machine and provides a standing, leaning, or sitting location for the operator. The chassis also supports a powered steering device that enhances maneuverability of the floor care machine Further, the chassis of one embodiment of the present invention is associated with wheels positioned in such a way to allow the floor care machine to rotate about 360 degrees without substantially traversing in any other direction.

It is yet another aspect of the present invention to provide a floor care machine that can be used in various floor maintenance operations. In one embodiment, the present invention is able to accommodate a plurality of floor care elements to perform a variety of floor care operations. It is envisioned that the floor care elements be capable of quick removal and replacement such that the purpose of the machine can be quickly changed. Thus, it is contemplated, that this system may be used for a plurality of cleaning or floor treatment operations, such as burnishing, scrubbing, etc.

It is another aspect of one embodiment of the present invention to provide a floor care machine that employs an easily removable burnishing assembly. More specifically, one embodiment of the present invention employs a motor that provides rotational energy to an attached burnishing assembly. The motor is supported by a linkage interconnected to the chassis and a spring that effectively allows the burnishing assembly to "float" on the floor. As one of skill in the art will appreciate, the amount of burnishing pressure applied to a floor is a function of the motor weight and the spring tension.

The burnishing assembly of one embodiment of the present invention includes a pad carrier that accommodates a burnishing pad. A pad driver, which is also associated with the pad carrier, receives a driver hub that is interconnected to the motor. The pad driver includes a recess or opening for receipt of a driver hub. In operation, the burnishing assembly is placed under the driver hub and lifted, which locates the driver hub into the recess of the pad driver. Slight rotation of the burnishing assembly will attach it to the driver hub.

It is a related aspect of embodiments of the present invention to provide a way of interconnecting the burnishing assembly to the floor care machine in quick and efficient manner. More specifically, the burnishing assembly is installed and removed primarily by feel. An instructional decal on the burnishing assembly may be provided to assist the operator in replacing the burnishing assembly. Initially, the driver hub is locked to prevent rotation. After it is locked, a slight counterclockwise rotation of the assembly will disengage the burnishing assembly from the driver hub. Similarly, to install a new burnishing assembly, the pad driver is placed generally under the driver hub and lifted where the recess of the pad driver will eventually contact with an outer surface of the driver hub.

In one embodiment of the present invention, the recess and the driver hub are shaped such that the driver hub will automatically align the burnishing assembly. A slight rotation of the burnishing assembly in a clockwise direction will temporarily fix the pad driver to the driver hub. One of skill in the art will appreciate that the burnishing assembly can be removed by clockwise rotation and attached by a counterclockwise rotation. Complete interconnection between the pad driver and the driver hub occurs when the operator initiates rotation of the burnishing assembly.

It is another aspect of the present invention to provide a floor treatment apparatus that reduces vibration. As briefly mentioned above, it is desirable to maintain vibrations generated by the burnishing operation at a level that does not reduce performance or cause operator discomfort. The burnishing assembly of embodiments of the present invention minimizes vibration in three ways. First, the center of gravity of the burnishing assembly is coaxial with the motor shaft, which balances the rotating mass. Second, the configuration of the pad mounted to the burnishing assembly ensures that it is always correctly placed on the driver hub. Third, the driver hub is interconnected to the pad drive with zero clearance, which is achieved by employing a driver hub with a tapered outer surface that fits within a tapered recess of the pad driver. The driver hub may also include a plurality of outwardly extending arms that interface with ramps integrated into the pad driver to firmly seat the driver hub into the pad driver. Indeed, the seating effect may increase as the assembly is rotated clockwise or counterclockwise.

It is another aspect of the present invention to provide a shroud positioned about the burnishing pad that contains debris generated by the burnishing process. Many burnishing assemblies require that the pad pressure be set before burnishing begins and/or adjusted during operation. However, as the thickness of the pad decreases, applied pressure and shroud drag also changes. Pressure increases rotational resistance to the battery-powered motor and thus negatively affects floor care machine run time. Further, too much or too little pad pressure will yield less than ideal floor finish. One embodiment of the present invention employs a two-piece "floating" shroud system that works in conjunction with the floating burnishing assembly described above to help eliminate these issues.

The floating shroud system of one embodiment of the present invention maintains a constant contact with the floor so that dust generated by the burnishing process is contained. Further, as the shroud floats relative to the motor, it is not affected by the thickness of the pad which can change through use and replacement. In one embodiment of the present invention the shroud is comprised of an inner fixed shroud that is interconnected to the motor and an outer movable shroud that contacts the floor via a soft nylon bristled skirt. The main benefit of a two-piece shroud is that it automatically maintains a constant pad pressure and shroud pressure on the floor being burnished. More specifically, as the pad wears, the distance between the motor and interconnected fixed shroud to the floor will decrease. If the outer shroud was fixed, this would cause the shroud to "drag" across the floor. Here, however, as the pad wears, the outer shroud will separate from the inner shroud, thereby maintaining the amount of contact applied to the floor. Again, pad pressure is controlled independently by springs with a low spring rate. Additionally, when a newer (thicker) pad is installed, there are no pressure settings to adjust. These features keep current usage constant as the pad wears which will keep the battery run time optimized.

It is another aspect of the present invention to provide a floor care machine, comprising: a chassis having a front and a back and with a lower surface, a front surface adjacent the front, an upper surface, a rear surface adjacent the back, a left surface and a right surface; a first wheel operably interconnected to the lower surface adjacent to the left surface and located closer to the rear surface than the front surface; a second wheel operably interconnected to the lower surface adjacent the right surface and located closer to the rear surface than the front surface; a platform located substantially between at least a portion of the right surface, at least a portion of the left surface and extending rearwardly from a portion of the rear surface, the platform also substantially located within the chassis and positioned substantially directly above an axis extending between the center of the first wheel and the center of the second wheel and wherein the platform includes a top surface which is adapted to receive the feet of an operator, a throttle and an operator presence device operatively connected to and which selectively interrupts operation of the throttle; a powered wheel operably connected adjacent the lower surface of the chassis; a steering mechanism substantially housed within the chassis and having a portion that is accessible by an operator; a motor associated with at least one of the chassis and the housing, the motor having a rotating shaft interconnected to a driver hub, the driver hub having a first outer surface; and a floor care element interconnected to the motor, the floor care element comprised of a pad carrier having a pad on one side and a pad driver on an opposite side, the pad driver having an opening defined by a second surface that is complementary to the first surface of the driver hub.

It is still yet another aspect of the present invention to provide a burnishing assembly, comprising: a pad carrier having a first side and a second side; a burnishing pad interconnected to the second side; a pad driver interconnected to the first side, the pad driver having an internally-disposed opening with first mating surface and an upper surface that encircles an upper edge of the first mating surface, the upper surface having a plurality downwardly-angled portions that terminate at corresponding openings, the openings associated with protrusions that extend towards an end of the downwardly-angled portions, the protrusions interconnected to a vertical surface, which is also interconnected to the pad carrier, to define a cavity that is adapted to receive a component of a complementary outer profile.

It is another aspect of the present invention to provide a method of interconnecting a floor care element to a floor care machine, comprising: raising a motor associated with the floor care machine to move a pad of the floor care element away from a floor; positioning the floor care element under the motor of the floor care machine; raising the floor care element to associating an interface thereof with a driver hub of the motor; positioning arms of the driver hub within openings of the interface; further raising the floor care element such that complementary of the interface and the drive hub engage; rotating the floor care element a predetermined amount; and engaging a portion of the arm onto a retaining member of the interface.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
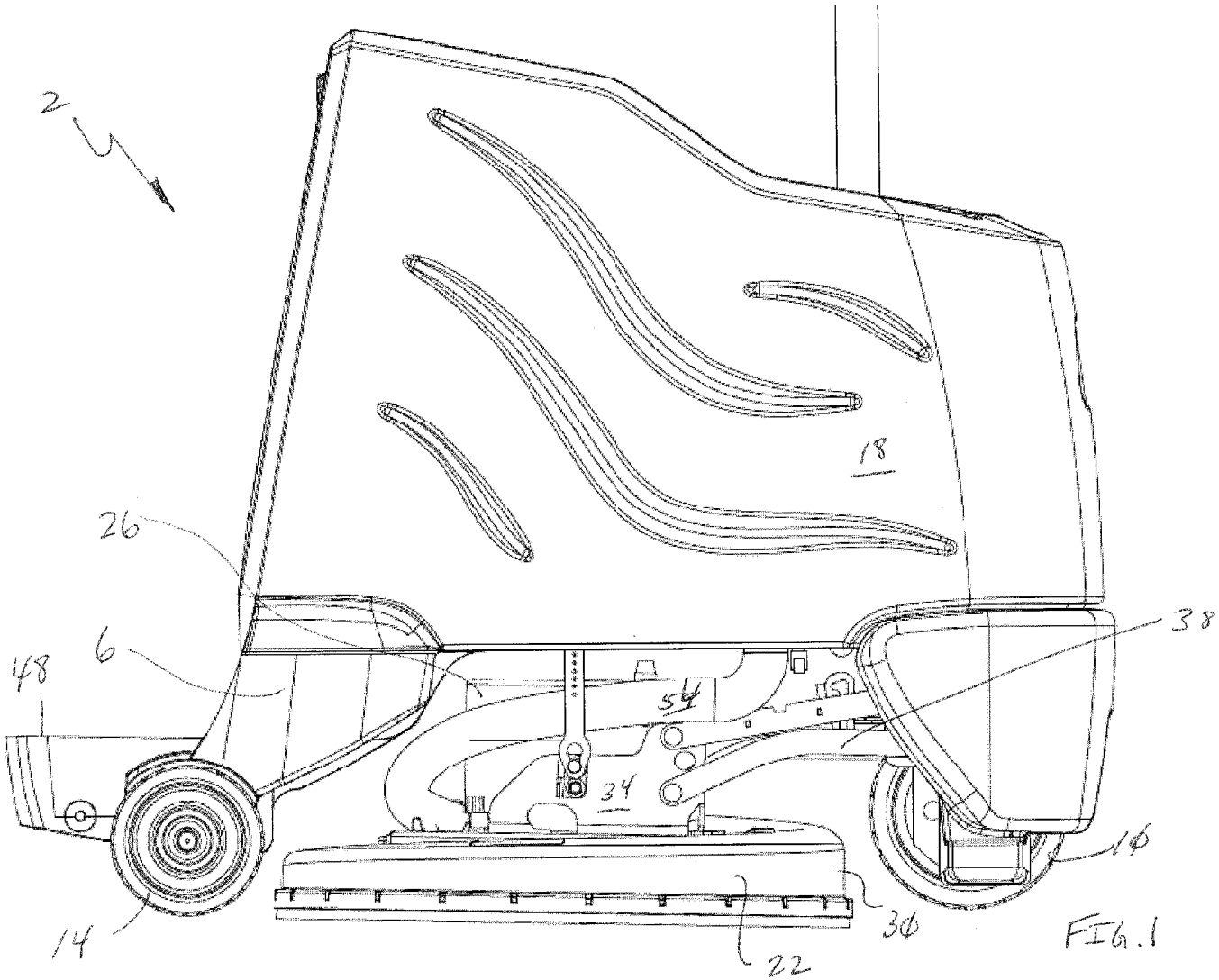
FIG. 1 is a side elevation view of the floor care machine of one embodiment of the present invention.

To assist in the understanding of one embodiment of the present invention, the following list of components and associated numbering found in the drawings is provided herein:

| # | Component |
|---|---|
| 2 | Floor care machine |
| 6 | Chassis |
| 10 | Front wheel |
| 14 | Rear wheels |
| 18 | Housing |
| 22 | Burnishing assembly |
| 26 | Motor |
| 30 | Shroud |
| 34 | Bracket |
| 38 | Linkage |
| 42 | Support spring |
| 48 | Platform |
| 50 | Pad |
| 54 | Hose |
| 58 | Pad driver |
| 62 | Driver hub |
| 66 | Pad carrier |
| 70 | Ramp |
| 74 | Opening |
| 78 | Protrusions |
| 82 | Stop surface |
| 86 | Upper surface |
| 90 | Retaining members |
| 94 | Arm |
| 98 | Locking mechanism |
| 102 | Recess |
| 106 | Outer surface |
| 110 | Opening |
| 114 | Inner surface |
| 118 | Outer surface |
| 122 | Fixed shroud |
| 126 | Outwardly extending lip |
| 130 | Inwardly extending lip |
| 134 | Movable shroud |
| 138 | Skirt |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 2:
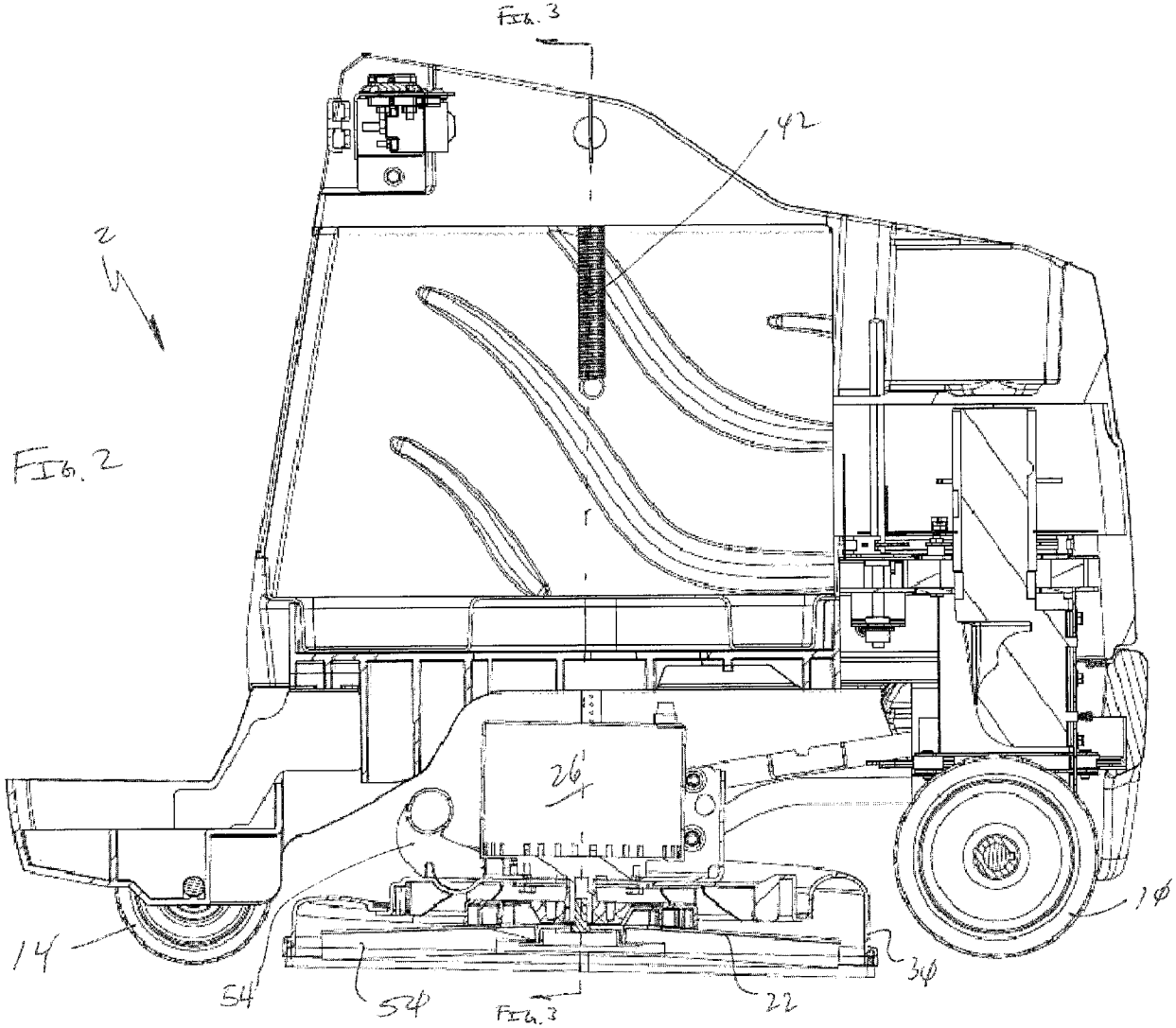
FIG. 2 is a cross section of FIG. 1.
Figures 3, 4:
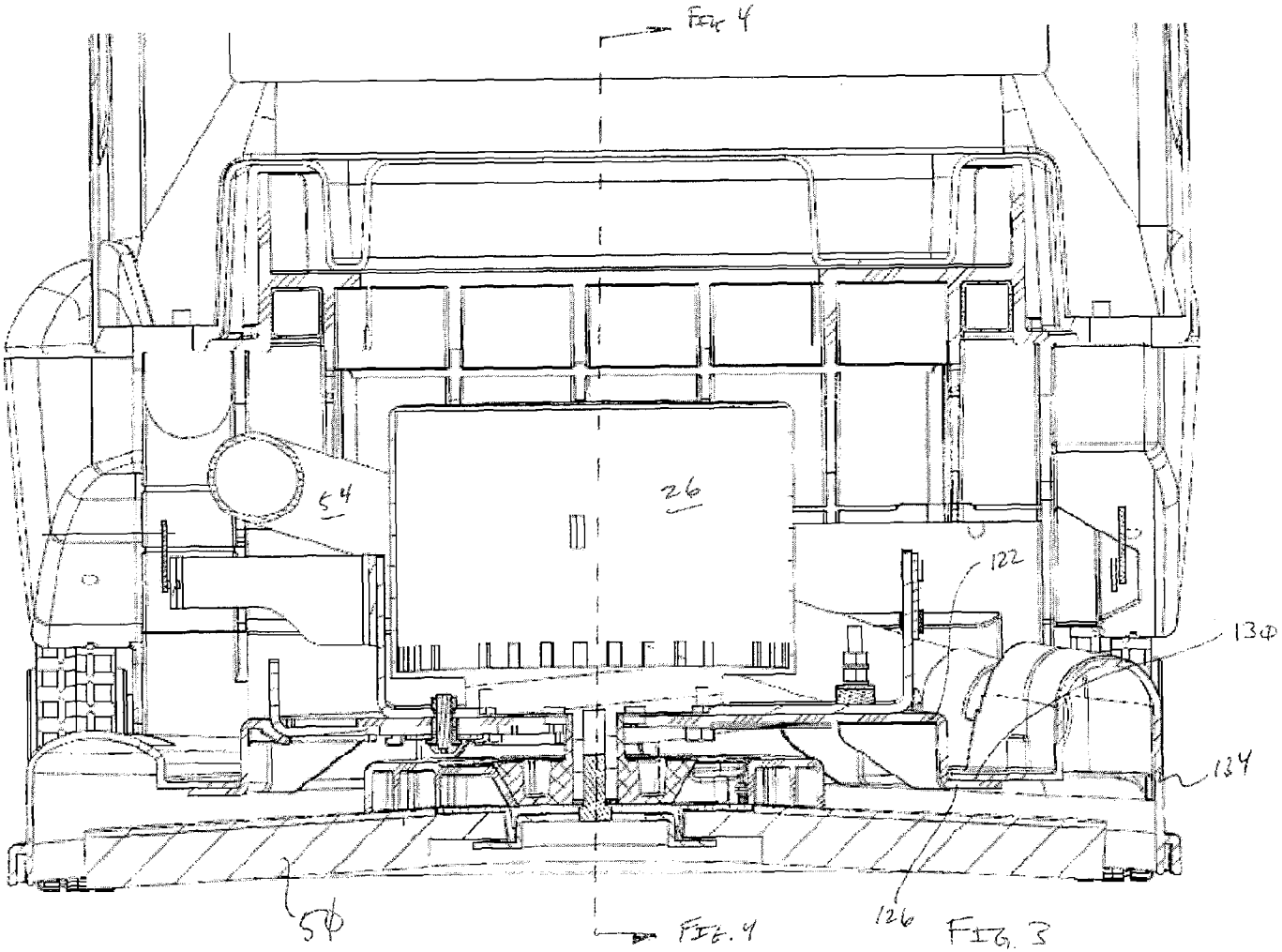
FIG. 3 is a cross section of FIG. 2.
FIG. 4 is a detailed view of FIG. 2 showing a burnishing assembly.
Figure 4:
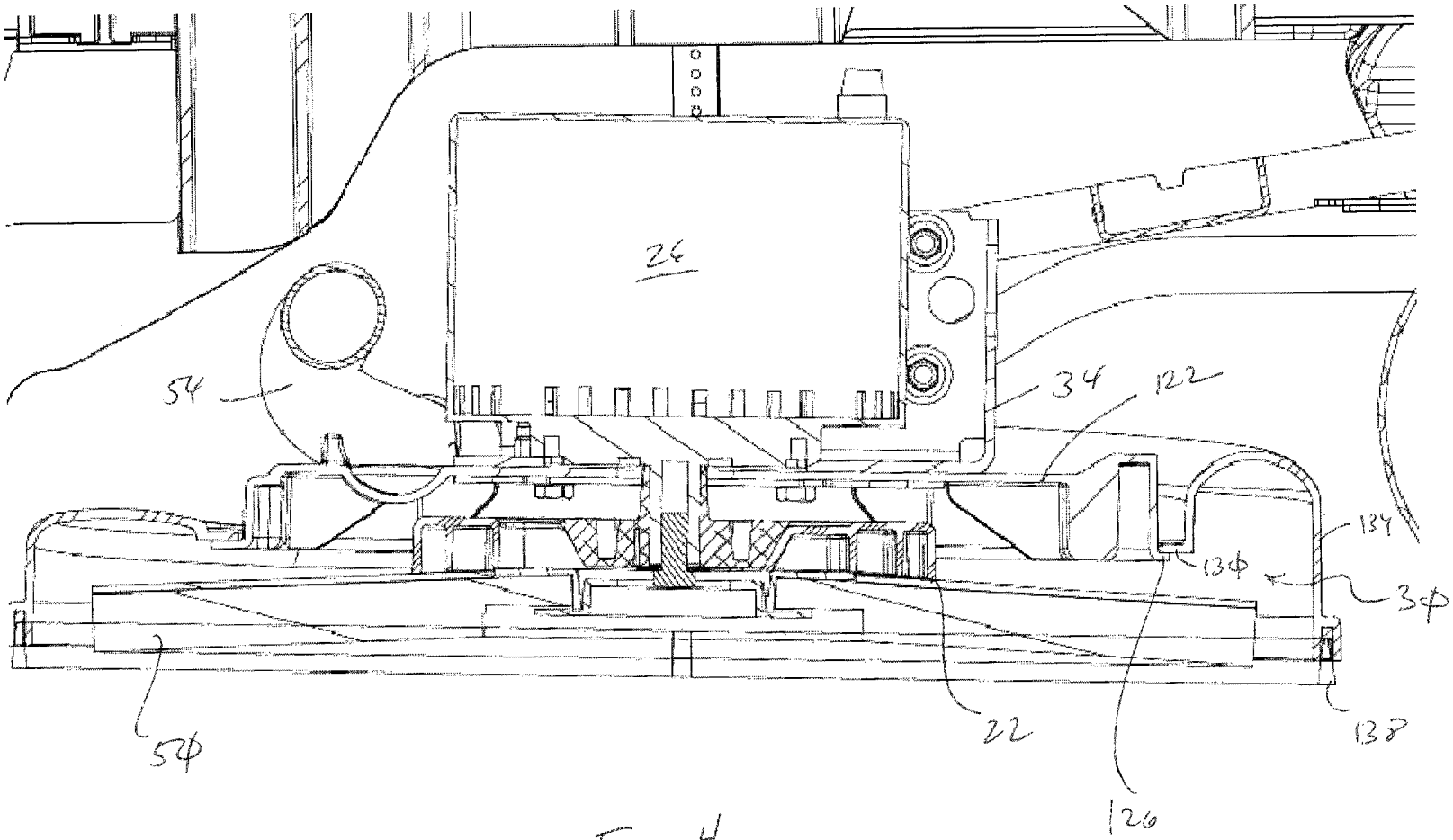

Referring now to FIGS. 1-4, a floor care machine 2 of one embodiment of the present invention is shown that includes a chassis 6 that supports a front wheel 10 and two rear wheels 14. The chassis 6 also supports a housing 18 that conceals a majority of the internal componentry of the floor care machine 2. Positioned between the front wheel 10 and the rear wheels 14 is a motor 26 with an interconnected burnishing assembly 22.

The burnishing assembly 22 is surrounded by a shroud 30, which will be described in further detail below. The motor 26 is supported by a bracket 34 and associated linkage 38 that is interconnected to the chassis 6. A support spring 42 controls the downward force of the motor 26 and interconnected burnishing assembly 22, which allows the burnishing assembly to "float" on the floor. The floor treatment machine may also include a platform 48 that accommodates an operator.

The burnishing assembly 22 is capable of at least two positions of use: 1) elevated, which allows the floor care machine to be moved easily, and 2) lowered, which engages a pad 50 to the floor. During high speed polishing, debris will be generated and captured by the shroud 30. The debris is suctioned from the shroud by the evacuator hose 54. As the burnishing process continues, the pad 50 will eventually wear and require replacement, which will be described in further detail below.

Figure 5:
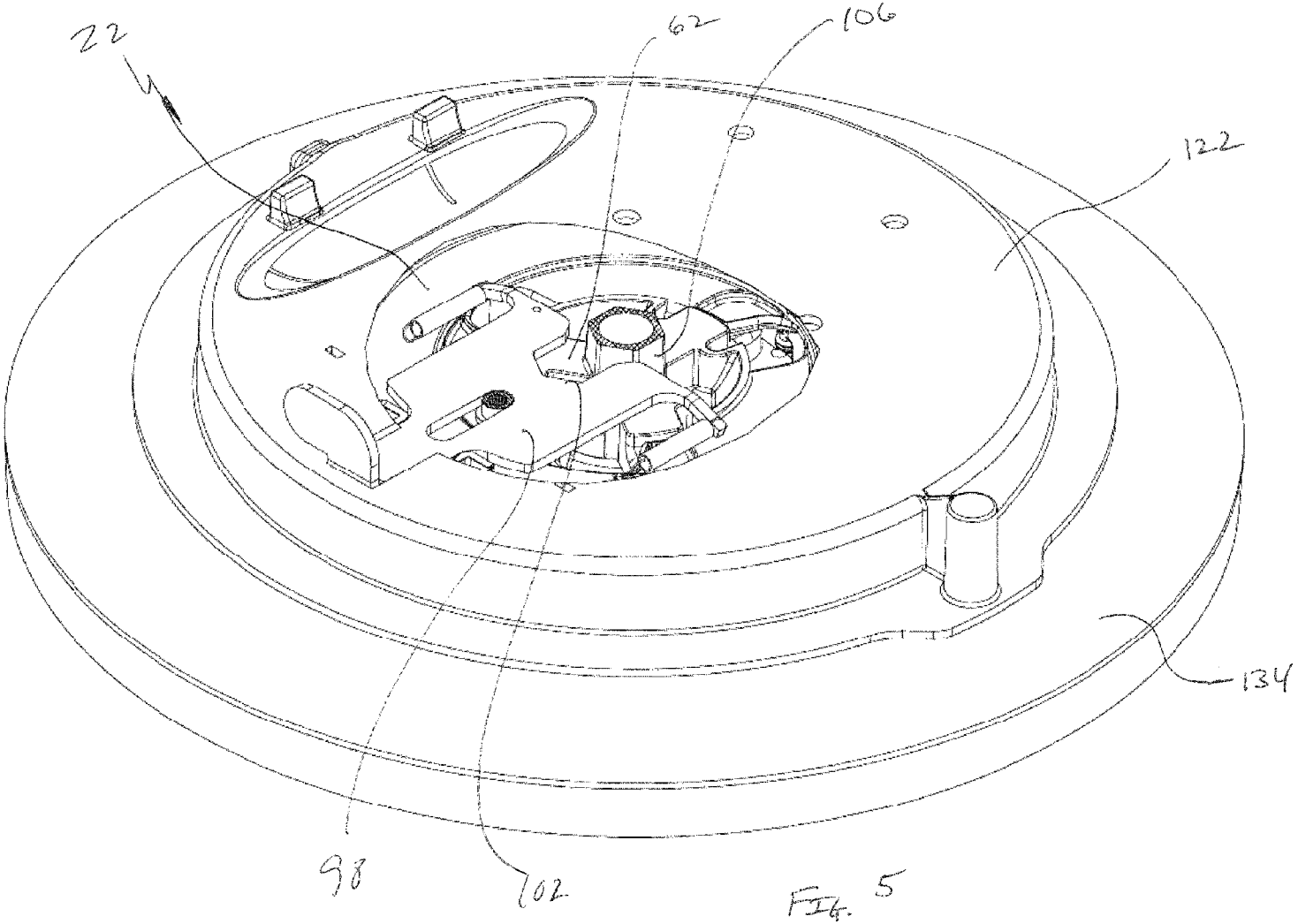
FIG. 5 is a top perspective view of the burnishing assembly.
Figure 6:
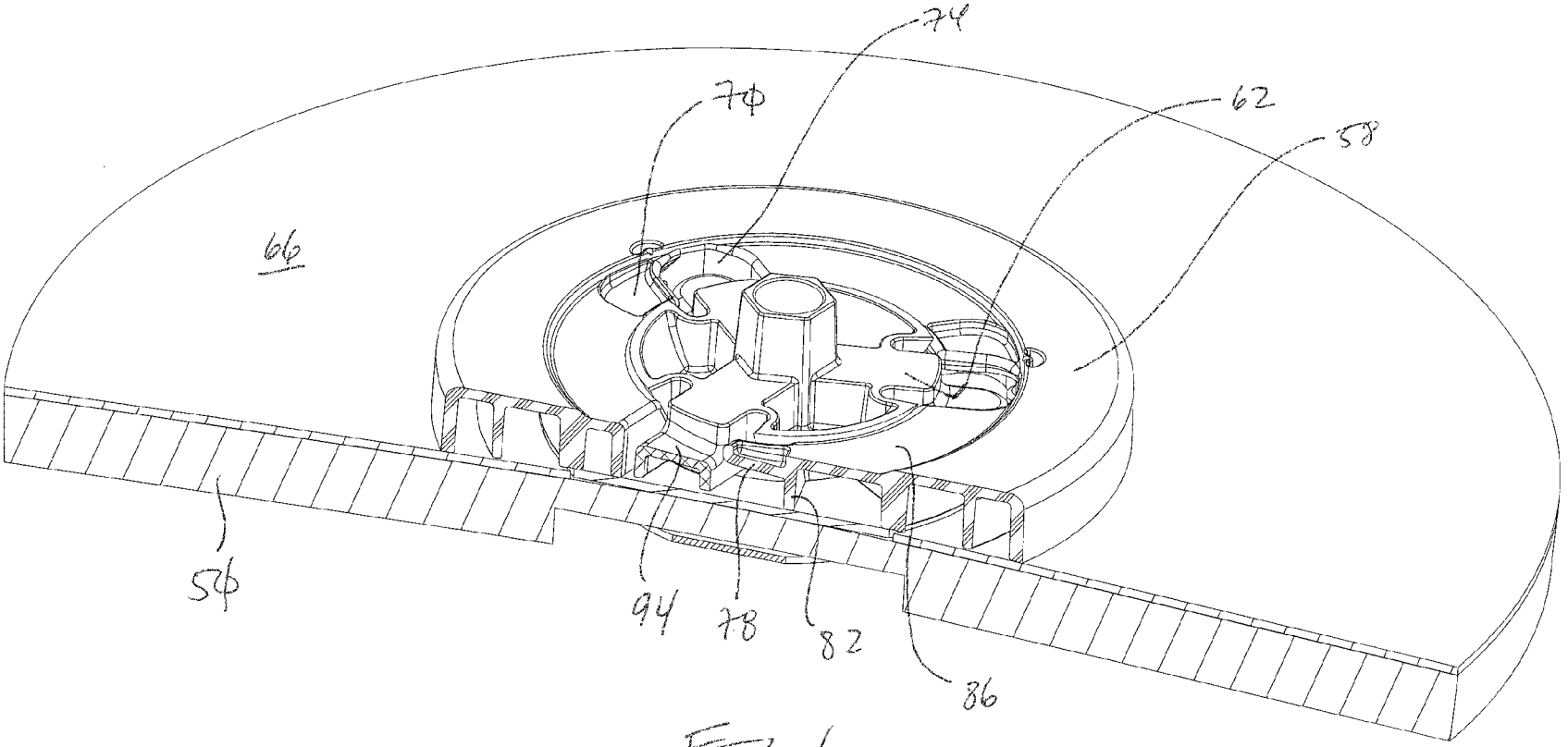
FIG. 6 is a cross section of FIG. 5, wherein a shroud has been omitted for clarity and wherein a driver hub has been inserted into a pad driver.
Figure 7:
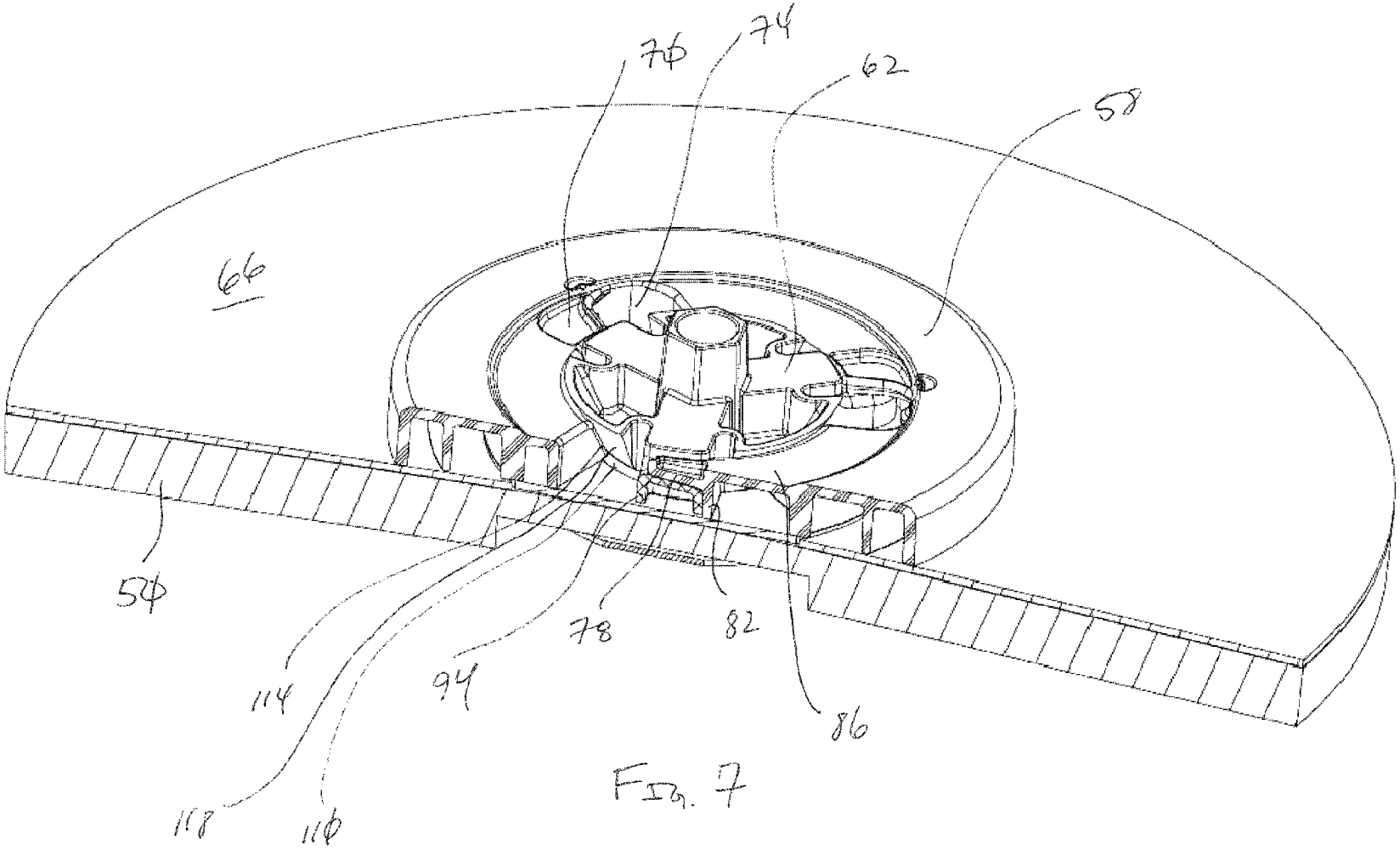
FIG. 7 is a cross section of FIG. 5, wherein the shroud has been omitted for clarity and wherein the driver hub has been locked into the pad driver.
Figure 8:
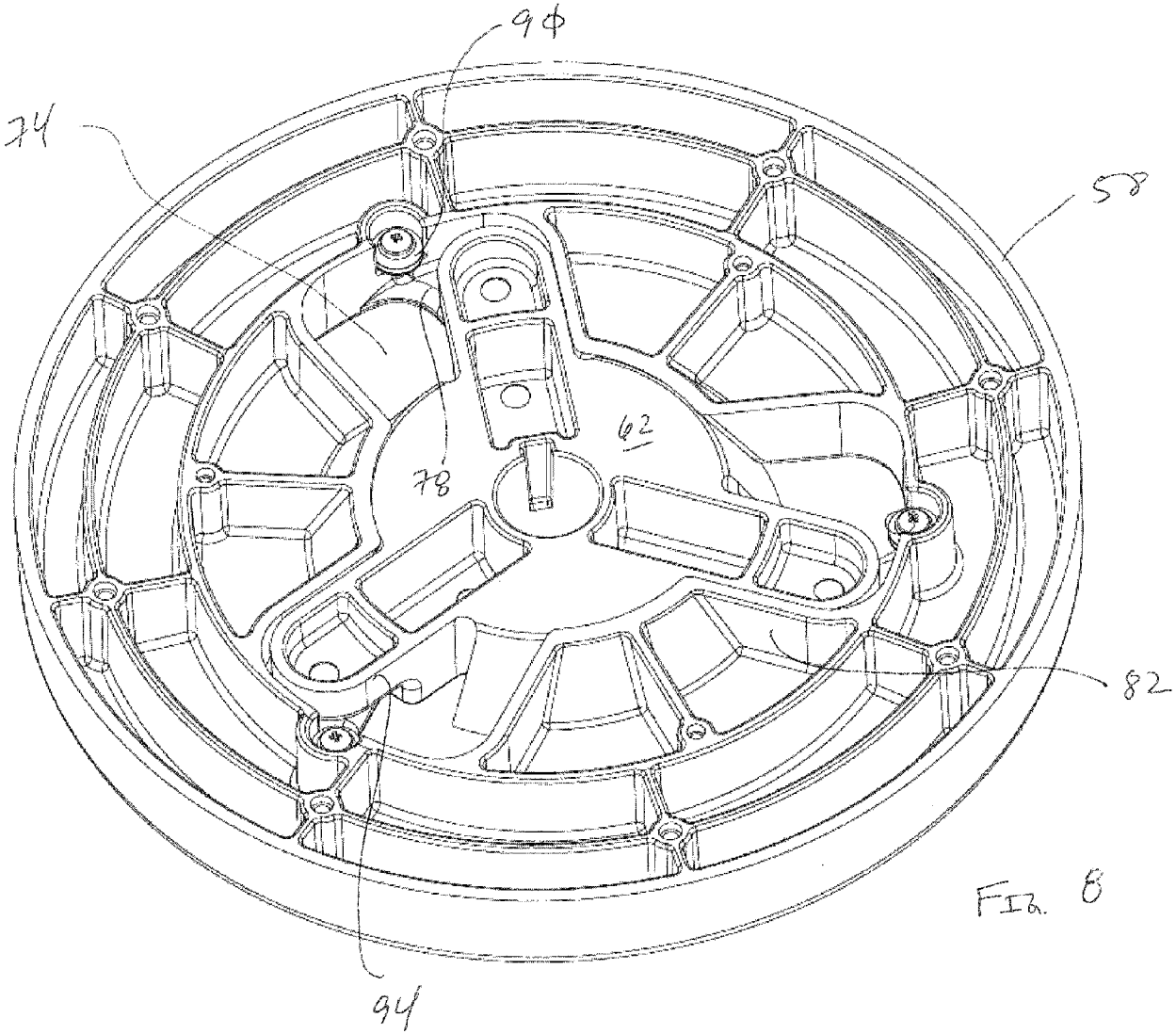
FIG. 8 is a bottom perspective view of the burnishing assembly showing the engagement of a driver hub to a pad driver.

FIGS. 3-8 illustrate how the burnisher assembly 22 of one embodiment of the present invention is interconnected and removed from the motor 26. The burnisher assembly 22 includes a pad driver 58 that interconnects to a motor-driven drive hub 62. The pad driver 58 is also interconnected to a pad carrier 66. The opposite side of the pad carrier 66 receives the pad 50. In some embodiments of the present invention the pad driver 58 and pad carrier 66 are made of a plastic material such that the entire burnishing assembly 22 is replaceable. The pad driver 58 includes a plurality of ramps 70 that are separated by openings 74. The pad driver 58 also includes protrusions 78 that extend into the openings 74 and are angled slightly upwardly relative to a top surface of the pad carrier 66. The protrusions 78 extend from stop surfaces 82 and extend downwardly from an upper surface 86 of the pad driver 58 to contact the pad carrier 58. Further, the underside of the pad driver 58 includes retaining members 90 which will be described in further detail below.

To interconnect the burnishing assembly 22 to the floor care machine, the drive hub 62 must be interconnected to the pad driver 58. Initially, the motor 26 and associated burnishing assembly 22 are raised wherein the pad 54 is elevated above the floor. The burnishing assembly 22 is rotated to align arms 94 of the driver hub 62 with the openings 74 in the pad driver 58, which allows the burnishing assembly 22 to separate from the driver hub 62. As the burnishing assembly is interconnected to a motor shaft that is apt to rotate, in some instances a locking mechanism 98 must first be used so that the burnishing assembly 22 will rotate independently of the drive hub 62. The locking mechanism 98 preferably has a hexagonal recess 102 that selectively receives the hexagonal outer surface 106 of the driver hub 62. When engaged, the driver hub 62 is not able to rotate, which allows the burnishing assembly 22 to rotate relative to the fixed driver hub 62.

To interconnect a new burnishing assembly 22 to the driver hub 62, the burnishing assembly 22 is first positioned directly below the driver hub 62. Again, to prevent rotation of the driver hub 62, the locking mechanism 98 may be actuated wherein the outer surface 106 of the driver hub 62 is fit within the recess 102 of the locking mechanism 98. Next, the burnishing assembly 22 is lifted upwardly to insert the driver hub 62 within an opening 110 of the pad driver 58. With specific reference to FIG. 6, the inner surface 114 of the pad driver 58 and the outer surface 118 of the driver hub 62 are complimentary wherein when they are brought together they self-align and center. In one embodiment of the present invention the outer surface 118 of the driver hub 62 is frusto-conical, as such a shape allows for the burnishing assembly 22 to be self-aligning within a complementary surface as it is raised into place, which aids the operator in interconnecting the burnishing assembly "in the blind". However, other shapes could be utilized with the driver hub with equal effect.

As the burnishing assembly 22 is raised, openings 74 of the pad driver 58 accept the arms 94 of the driver hub 62. If the arms 94 are not rotationally aligned with the opening 74, the arms 94 will contact the ramps 70 provided on the upper surface 86 of the pad driver 58. Rotation of the burnishing assembly 22 will then needed to guide the arms 94 into the openings 74. Once the arms 94 are fitted through the openings 74, the burnishing assembly 22 may be completely raised into place and rotated slightly to position the arms 94 beneath the protrusions 78 associated with the openings 74 of the pad driver 58. The protrusions 78 employ an upwardly angled surface that correspond with downwardly-angled surfaces of the arms 94. The arms 94 are rotated further until they contact the retaining features 90. In one embodiment of the present invention the retaining features 90 are rubber overwrapped screws that frictionally engage a portion of the arms 94 to keep the burnishing assembly 22 is temporarily fixed to the driver hub 62. After this step, the pad assembly is interconnected to the driver hub 62 and the locking mechanism 98 may be transitioned away from the driver hub.

To finalize the interconnection of the burnishing assembly 22 to the driver hub 62, the motor is initiated to rotate the driver hub 62 at high speeds which will dislocate the arms 94 from the retaining members 90 and urge the arms against a corresponding stop surface 82. The rotational forces generated by the arms 94 will be directly transferred to the pad driver 58, which will in turn spin the burnishing assembly 22. The complementary nature of the outer surface 106 of the driver hub 62 and the inner surface 114 of the opening 110, and the complementary nature of the arm 94 and the protrusion 78 provide a snug-zero tolerance fit between the driver hub 62 and the pad driver 58 which will reduce vibrations generated by the spinning pad 50.

Referring again to FIGS. 3 and 4, a two piece shroud system 30 employed by embodiments of the present invention is shown. Here, the shroud includes a fixed upper shroud 122 that is secured to the motor 26 and/or bracket 34. As the pad 50 wears, the motor 26, burnishing assembly 22, and fixed shroud 122 will move closer to the floor. The fixed shroud 122 includes an outwardly-extending lip 126 that engages an inwardly extending lip 130 of an outer, movable shroud 134. As the inner shroud 122 moves closer to the floor, engagement between the lips of the outer shroud 134 and inner shroud 122 will break and the location of the outer shroud 134 will be maintained. No loss of suction occurs because a seal is maintained between the fixed shroud and the outer shroud. This feature of the invention has advantages over the prior art as the outer shroud 134 is not forced against the floor as the pad wears and thus contact and associated drag between the shroud and the floor is maintained. The outer shroud 134 also includes a flexible skirt 138 that accommodates deflections of the outer shroud while ensuring that the majority of debris generated by the pad 50 is captured.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A floor care machine, comprising:

a chassis having a front and a back and with a lower surface, a front surface adjacent the front, an upper surface, a rear surface adjacent the back, a left surface and a right surface;

a first wheel operably interconnected to the lower surface adjacent to the left surface and located closer to the rear surface than the front surface;

a second wheel operably interconnected to the lower surface adjacent the right surface and located closer to the rear surface than the front surface;

a platform located substantially between at least a portion of the right surface, at least a portion of the left surface and extending rearwardly from a portion of the rear surface, the platform also substantially located within the chassis and positioned substantially directly above an axis extending between the center of the first wheel and the center of the second wheel and wherein the platform includes a top surface which is adapted to receive the feet of an operator, a throttle and an operator presence device operatively connected to and which selectively interrupts operation of the throttle;

a powered wheel operably connected adjacent the lower surface of the chassis;

a steering mechanism substantially housed within the chassis and having a portion that is accessible by an operator;

a motor associated with at least one of the chassis and a housing, the motor having a rotating shaft interconnected to a driver hub, the driver hub having a first outer surface;

a floor care element interconnected to the motor, the floor care element comprised of a pad carrier having a pad on one side and a pad driver on an opposite side, the pad driver having an opening defined by a second surface that is complementary to the first surface of the driver hub; and wherein the pad driver employs a plurality of openings that receive corresponding arms of the driver hub, the pad driver engaging a portion of the arms when the floor care element is rotated relative to the driver hub.

2. The floor care machine of claim 1, wherein the first surface of the driver hub is frusto-conical.

3. The floor care machine of claim 1, further comprising a shroud having a first portion interconnected to the motor and a second portion selectively interconnected to the first portion, wherein the motor is associated with the at least one of the chassis and the housing by way of at least one spring, the first portion of the shroud adapted to move along with the motor and the second portion of the shroud being able to move independently from the first portion.

4. The floor care machine of claim 3, further comprising a hose associated with the shroud that is adapted to draw debris from the annulus defined by the shroud.

5. The floor care machine of claim 1, wherein the floor care element includes a lock that selectively engages the driver hub to prevent rotation of the driver hub.

6. The floor care machine of claim 1, wherein the openings are associated with protrusions, the protrusions having an upwardly-angled profile that engages a downwardly-angled upper surface of the plurality of arms.

7. A floor care machine, comprising:

a chassis having a front and a back and with a lower surface, a front surface adjacent the front, an upper surface, a rear surface adjacent the back, a left surface and a right surface;

a first wheel operably interconnected to the lower surface;

a second wheel operably interconnected to the lower surface;

a platform located substantially between at least a portion of the right surface, at least a portion of the left surface and extending rearwardly from a portion of the rear surface;

a powered wheel operably connected adjacent the lower surface of the chassis;

a motor associated with at least one of the chassis and a housing, the motor having a rotating shaft interconnected to a driver hub, the driver hub having a first outer surface;

a floor care element interconnected to the motor, the floor care element comprised of a pad carrier having a pad on one side and a pad driver on an opposite side, the pad driver employing a plurality of openings that receive corresponding arms of the driver hub, the pad driver engaging a portion of the arms when the floor care element is rotated relative to the driver hub.

8. A method of interconnecting a floor care element to a floor care machine, comprising:

raising a motor associated with the floor care machine;

positioning the floor care element under the motor of the floor care machine;

raising the floor care element to associate it with a driver hub of the motor;

positioning arms of the driver hub within openings of the interface;

further raising the floor care element such that complementary components of the interface and the drive hub engage;

rotating the floor care element a predetermined distance to engage a portion of the arm onto a retaining member of the interface;

wherein the floor care element is a burnishing assembly, comprising:

a pad carrier having a first side and a second side;

a burnishing pad interconnected to the second side;

a pad driver interconnected to the first side, the pad driver having an internally-disposed opening with first mating surface and an upper surface that encircles an upper edge of the first mating surface, the upper surface having a plurality downwardly-angled portions that terminate at corresponding openings, the openings associated with protrusions that extend towards an end of the downwardly-angled portions, the protrusions interconnected to a vertical surface, which is also interconnected to the pad carrier, to define a cavity that is adapted to receive a component of a complementary outer profile; and wherein the pad driver is adapted to receive the driver hub that is interconnected to the motor, the driver hub having a second mating surface that is complementary to the first mating surface, the hub also having a plurality of arms that are received within the plurality of openings, the arms having a profile that possesses the complementary outer profile that is received within the cavities.

9. The method of claim 8, further comprising actuating a lock associated with the floor care element to contact the driver hub to prevent unwanted rotation thereof.

10. The method of claim 8, wherein the first mating surface is frusto-conical.

11. The method of claim 8, further comprising a retaining member positioned adjacent to the opening and extending from the protrusion.

12. The method of claim 11, wherein the retaining member is a rubber over-wrapped fastener.

* * * * *